US005842840A

United States Patent [19]

Korek et al.

[11] Patent Number: 5,842,840

[45] Date of Patent: Dec. 1, 1998

[54] CENTRIFUGAL FAN WITH AN INTEGRATED CONTROL MODULE ESPECIALLY FOR USE IN MOTOR VEHICLES

[75] Inventors: Miroslaw Korek, Les Essarts Leroi; Stéphane Pernet, Paris, both of France

[73] Assignee: Valeo Climatisation, La Verriere, France

[21] Appl. No.: 823,816

[22] Filed: Mar. 24, 1997

[30] Foreign Application Priority Data

Mar. 26, 1996 [FR] France ..... 96 03743

[51] Int. Cl.[6] ..... F04B 35/04

[52] U.S. Cl. ..... 417/423.14; 417/366; 415/211.2

[58] Field of Search ..... 417/366, 423.7, 417/423.14; 415/175, 176, 208.1, 211.2

[56] References Cited

U.S. PATENT DOCUMENTS

| | | | |
|---|---|---|---|
| 2,247,817 | 7/1941 | McMahan | 417/423.14 |
| 3,251,540 | 5/1966 | Kinsworthy | 417/423.14 |
| 5,531,267 | 7/1996 | Ahmed et al. | 415/208.1 |
| 5,738,492 | 4/1998 | Stanko et al. | 415/211.2 |

FOREIGN PATENT DOCUMENTS

| | | |
|---|---|---|
| 0 501 198 | 9/1992 | European Pat. Off. . |
| 2 676 610 | 11/1992 | France . |
| 94.15508 | 12/1994 | France . |
| 39 16791 | 5/1990 | Germany . |
| 44 10512 | 10/1995 | Germany . |

*Primary Examiner*—Charles G. Freay
*Attorney, Agent, or Firm*—Morgan & Finnegan, LLP

[57] ABSTRACT

A centrifugal fan comprises a volute casing having an electric motor, controlled by a control module, coupled to an impeller mounted in the center of the volute, whereby to force air through the volute. In a predetermined zone of the volute, there is at least one deflecting wall or baffle, the curvature of which is substantially the same as that of this zone. The casing carries fastening means which are arranged to retain at least an element of the control module in a position in which this control module element is substantially integrated with the deflecting baffle. The air flowing in the volute can thus pass over the control module element, so as to cool the latter, without the air stream undergoing any significant perturbation.

8 Claims, 2 Drawing Sheets

CENTRIFUGAL FAN WITH AN INTEGRATED CONTROL MODULE ESPECIALLY FOR USE IN MOTOR VEHICLES

FIELD OF THE INVENTION

This invention relates to centrifugal fans, especially for use in motor vehicles. More particularly, the invention is concerned with centrifugal fans of the type comprising a casing in the form of a volute, having a central region in which a fan impeller is driven in rotation by an electric motor controlled by a control module. The impeller is arranged to draw air axially from outside the casing and to deliver it radially into the volute.

BACKGROUND OF THE INVENTION

The control module consists of a number of electrical and electronic components which, in operation, give off heat. In order to protect the control module from deterioriation, which would substantially diminish the performance of the motor, it is imperative that the amount of heat given off be efficiently evacuated.

Various arrangements have been proposed in the past in order to meet this problem. Thus for example, it is known from French patent specification No. FR 2 676 610A to provide an auxiliary bypass duct in the volute, which takes some of the air delivered from the fan and passes it through a housing in which the control module is located.

It is also known from French patent application No. 94 15508 to provide a centrifugal fan in which the volute has an opening which is oriented towards the fan impeller, and which contains part of the control module, such as for example a transistor, so that the latter can be cooled by the airstream flowing in the volute.

In both of the above mentioned prior art arrangements, cooling of the control module results in high energy losses, and introduces perturbations in the flow of the air, thus reducing the output of the fan.

DISCUSSION OF THE INVENTION

One object of the invention is accordingly to provide a centrifugal fan which does not have the disadvantages of fans in the prior art.

According to the invention, a centrifugal fan, of the type comprising a casing in the form of a volute having a central portion containing a fan impeller which is driven in rotation by an electric motor, the said motor being controlled by a control module, the said fan impeller being adapted to drive air into the volute, is characterised in that the volute contains, in a predetermined zone of the volute having a given curvature, at least one deflecting wall or baffle, the curvature of which is substantially the same as that in the said zone, and in that the casing includes fastening means arranged to retain at least one part of the control module in a position in which the latter is effectively substantially integrated with the corresponding deflecting baffle, whereby the air flowing in the volute can sweep over the said part of the control module without thereby suffering any significant perturbation.

Thus, at least that part or those parts of the control module which have to be cooled are located directly inside the volute, and are effectively integrated with a deflecting baffle that directs the airflow on the delivery side of the fan. It is therefore no longer necessary to modify the general form of the casing in order to integrate those elements which are to be cooled.

Preferably, the or each part of the control module that is integrated with a deflecting baffle is a module for varying the speed of the fan impeller.

According to a preferred feature of the invention, the, or each, deflecting baffle is substantially parallel to one of the walls of the casing, and extends over a height which is substantially identical to that of the said wall of the casing. As a result, the predetermined zone in which the baffle is located is divided into two or more parts in accordance with the number of deflecting baffles provided, with each of these parts, or zones, thus channeling a corresponding part of the airstream without perturbing the flow.

The said fastening means are preferably sealingly mounted in one of the walls of the casing that define the volute.

According to another preferred feature of the invention, the said fastening means are in the form of electrical connectors, adapted to receive connecting tags or pins which form part of the said part of the control module that is integrated with the deflecting baffle. This enables the fan to be greatly simplified, because the fastening means then have two functions, namely that of retaining the said part of the control module and that of providing the electrical connections for the latter.

In preferred embodiments of the invention, the deflecting baffle associated with the said part of the control module to be cooled, is formed with a recess for receiving the latter. This recess is preferably formed at one end of the baffle, which is preferably the upstream end with reference to the direction of flow of air in the volute. The said part of the control module is therefore effectively integrated into the volute itself, in the main path of the airstream in the latter.

According to yet another preferred feature of the invention, the predetermined zone which contains the deflecting baffle or baffles is defined in a terminal downstream portion of the volute, again with reference to the direction of flow of air in the volute. Since in general the cross section of this downstream terminal portion is larger than that of the remainder of the volute upstream of it, the stream of air in this terminal portion is in consequence better distributed, and any perturbation induced by the presence of the control module part or parts in it is minimised.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
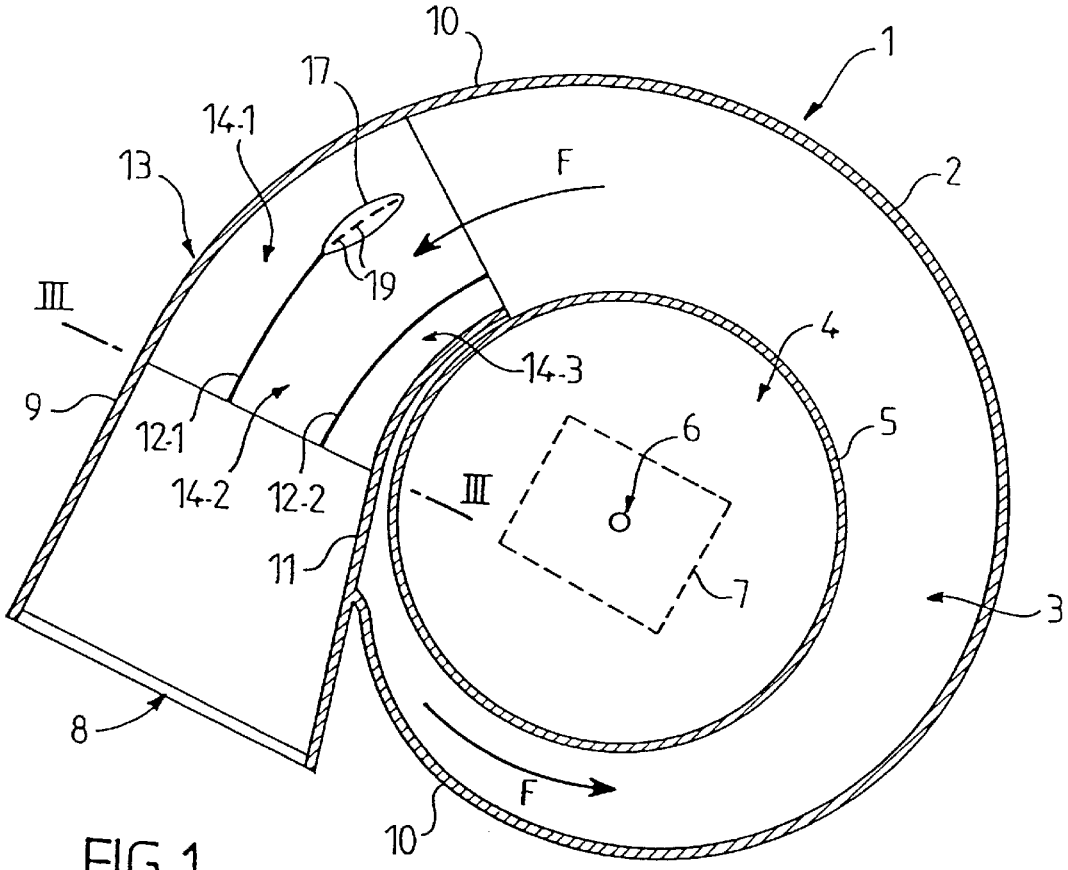
FIG. 1 is a view in diagrammatic transverse cross section, showing a centrifugal fan in accordance with the invention.

Reference is first made to FIG. 1, which shows a centrifugal fan 1. The fan 1 comprises a casing 2 in the form of a spiral volute 3 of increasing cross section, going in the direction of flow of the air indicated by the arrow F. The volute 3 is coiled around a central region 4, in which a fan impeller 5 is installed. The impeller 5 is arranged to be driven in rotation about an axis of revolution 6, by means of an electric motor 7 which is indicated in broken lines in FIG. 1.

Air is drawn in axially by the impeller 5, in a direction parallel to its axis of revolution 6, and is then impelled into the volute 3 by the centrifugal effect induced by the rotation of the impeller 5 about the axis of revolution 6. The impeller 5 has axial apertures through which the impelled air is expelled radially into the volute 3, in which it flows as generally indicated by the arrow F, until it is exhausted through an air outlet 8 situated at the terminal end of a downstream terminal portion 9 of the volute 3. The air outlet 8 is in communication with an apparatus for heating, ventilating and/or air conditioning, which is not shown in the drawings.

Figure 2:
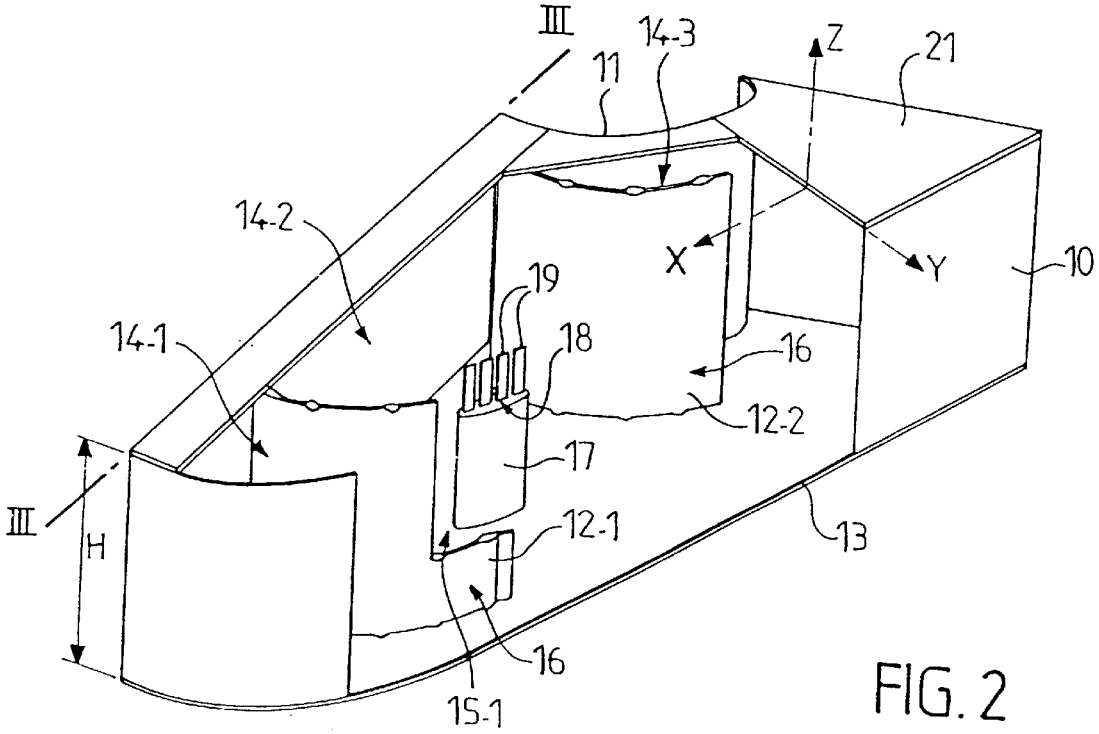
FIG. 2 is an exploded perspective view of that part of FIG. 1 which contains the deflecting walls or baffles, in a preferred embodiment of the invention.
Figure 3:
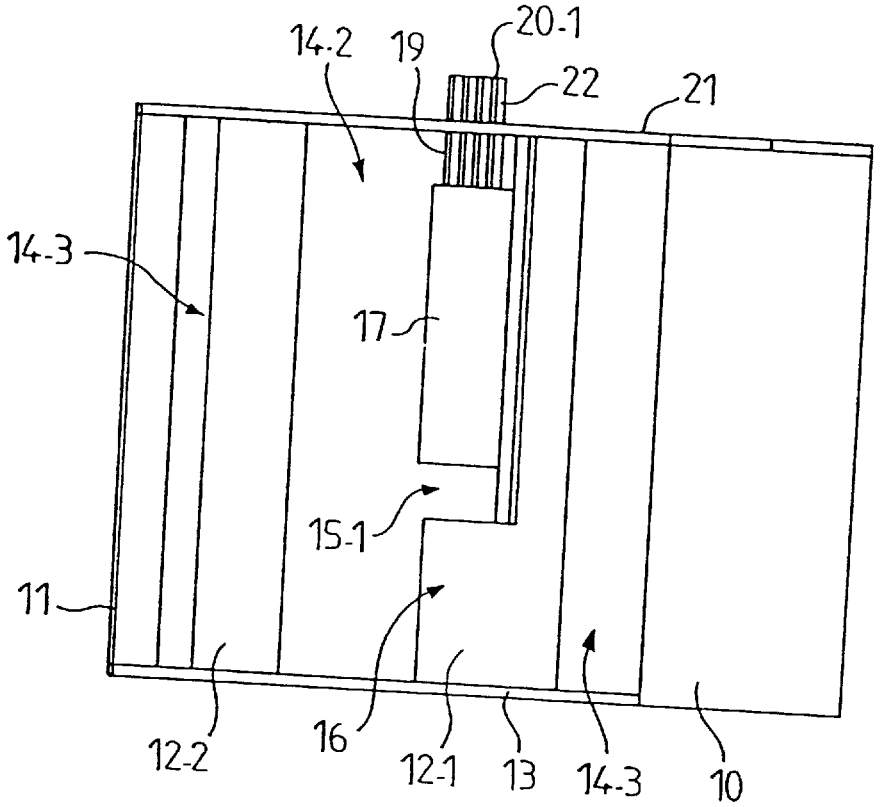
FIG. 3 is a view in transverse cross section taken on the line III—III in FIG. 1.

Reference is now made more particularly to FIGS. 2 and 3. The volute 3 is bounded by an outer side wall 10 and an inner side wall 11, together with an upper wall 21 and a lower wall 13. The side walls 10 and 11 stand in planes substantially parallel to each other, in the sense that the distance between the side wall 10 and the side wall 11, at any given transverse cross section of the volute along its length, is substantially the same over the whole height (H, FIG. 2) of these walls. The upper and lower walls 21 and 13 are also substantially parallel to each other and lie substantially at right angles to the inner and outer walls 10 and 11. Thus, in the embodiment shown in the drawings, the volute 3 has a transverse cross section which is substantially rectangular.

The terminal portion 9 of the volute 3 contains at least one deflecting wall or baffle 12, in a selected position or predetermined zone of the lower wall 13, FIG. 2. In the example shown in the drawings, this predetermined zone 13 of the volute contains two of these deflecting baffles, 12-1 and 12-2. These baffles extend substantially parallel to the outer wall 10 and inner wall 11, the baffle 12-1 being closer to the outer wall 10 and the baffle 12-2 closer to the inner wall 11. Consequently, as is best seen in FIG. 1, these baffles are provided with curvatures which are substantially identical, respectively, to those of the walls 10 and 11. The deflecting baffles 12 preferably extend over the same height H as the outer and inner walls 10 and 11. The baffles 12-1 and 12-2 thus divide the terminal portion 9 of the volute, in the selected region 13, into three ducts 14-1, 14-2 and 14-3, which channel the airstream delivered by the fan impeller 5.

In the example shown in the drawings, the deflecting baffle 12-1 is formed with a recess 15-1, which is preferably located in the region of one end 16 of the baffle, which is the upstream end with reference to the direction of flow of the air in the volute 3. A component 17, which constitutes at least part of the control module, is located in this recess 15-1. The component 17 will be referred to, for simplicity, as the control module 17. The recess 15-1 is dimensioned so as to be substantially equal to the dimensions of the control module 17. This type of module comprises a number of electrical and electronic components, and in particular transistors and power resistors which release a large amount of heat in operation. The module 17 is accordingly in the form of an elongated block having a transverse cross section which is substantially rectangular or elliptical, with smooth walls. The module has, on a terminal face 18, a set of rigid electrical connecting tags or pins 19. In the example shown, there are four of these tags.

The upper wall 21 carries an electrical connector 20-1 (FIG. 3), for connecting the module 17 to the remainder of the control circuit of the centrifugal fan. The connector 20-1 is arranged on the upper wall 21 directly above the recess 15-1 in the deflecting baffle 12-1, and has the additional function of holding the module 7 in position. The connector 20-1 includes a plurality of sockets 22 for receiving the respective connecting tags 19 of the module 17, with these tags extending through the upper wall 21 for this purpose. Accordingly, once the connecting tags 19 have been introduced into the female elements, or sockets, 22, the module 17 is fully held and immobilised in the selected position, and is thereby integrated substantially with the deflecting baffle 12-1.

The fan casing 2 is made of a suitable plastics material, preferably by moulding in two parts, the first of which includes the upper wall 21, which thereby constitutes a cover, while the second part includes in particular the outer wall 10, the inner wall 11 and the lower wall 13, together with the deflecting baffles 12-1 and 12-2.

The invention is not limited to the embodiment described above, but embraces all versions of the fan which could be developed or conceived by a person skilled in the art within the scope of the claims of this application. Thus for example, there may be one single deflecting baffle, or there may be more than two. Similarly, the deflecting baffle or baffles may be innocent of a recess such as the recess 15-1, to the extent that the control module, or that part of it which is incorporated into the volute, may be located in such a way as to constitute an extension of the upstream or downstream end of one of the baffles. In that case, the control module part concerned is an element abutted on the corresponding deflecting baffle.

In other versions, the recess may be formed in a location other than the upstream or downstream end of a deflecting baffle, for example in the middle of the baffle, given that the connecting tags should be accessible through either the upper wall or inner wall of the volute.

In another version, where it is thought necessary, a first control module may be lodged in a recess in one deflecting baffle, with a second control module being fitted in a position where it serves as an extension of one end of the same deflecting baffle. Again, several recesses may be formed in one deflecting baffle.

In addition, in the embodiment described above, the baffles are substantially parallel to the outer and inner walls 10 and 11 of the volute. It will however be clear that the deflecting baffles may be substantially parallel to the upper and lower walls 21 and 13. In this particular case, the connector (corresponding to the connector 20-1), which provides the electrical connections for that part of the control module that is integrated into the volute, would have to be mounted in the outer wall of the casing; and an additional appropriate fastening means would have to be provided for retaining the module in a plane substantially parallel to the upper and lower walls of the volute in order to overcome gravitational effects.

Finally, the terminal portion of the volute that includes the deflecting baffle or baffles may be made as a separate component from the remainder of the casing, which under these circumstances could be made in monobloc form.

What is claimed is:

1. A centrifugal fan comprising: a casing in the form of a volute, defining a central portion thereof; a fan impeller in the said central portion of the volute, for forcing air into and through the volute; an electric motor coupled to the impeller for driving the impeller in rotation; and a control module connected to the motor for controlling the motor, wherein the volute includes a predetermined zone of the volute having a predetermined curvature, the volute further including at least one deflecting baffle located in the said predetermined zone and having a curvature substantially identical to that of the said predetermined zone, at least part of the said control module being disposed within the said predetermined zone and being substantially integrated with at least one said baffle, the fan further including fastening means carried by the casing and retaining the said at least one part of the control module in position, the configuration of the said at least one part of the control module and the associated said baffle being such that air flowing in the volute can sweep over the said control module part while being substantially unperturbed thereby.

2. A fan according to claim 1, wherein the casing comprises a plurality of walls defining the volute, wherein said at least one deflecting baffle is substantially parallel to a first one of the said casing walls and has a height substantially identical to the height of the said first casing wall.

3. A fan according to claim 2, wherein the said fastening means are sealingly mounted in one of the said casing walls.

4. A fan according to claim 1, wherein the said at least part of the control module includes electrical connecting elements, the said fastening means comprising an electrical connector for receiving the said connecting elements.

5. A fan according to claim 1, wherein a said deflecting baffle defines a recess receiving the said at least one part of the control module.

6. A fan according to claim 5, in which a said deflecting baffle defines an upstream end thereof with reference to the direction of flow of air in the volute, the said recess being defined at the said upstream end of the baffle.

7. A fan according to claim 1, wherein the volute has a downstream terminal portion defining the said predetermined zone.

8. A fan according to claim 1, wherein the said part of the control module associated with a deflecting baffle is a module for varying the speed of rotation of the fan impeller.

* * * * *